350-333

XR 4,034,550

333

X 350/355

United Sta

Kouchi et al.

[11] 4,034,550

[45] July 12, 1977

[54] ELECTRONIC WRISTWATCH DIGITAL DISPLAY

[75] Inventors: Akihiko Kouchi; Shuji Takeda; Hiroshi Takeshita, all of Suwa, Japan

[73] Assignee: Kabushiki Kaisha Suwa Seikosha, Tokyo, Japan

[21] Appl. No.: 566,636

[22] Filed: Apr. 8, 1975

[51] Int. Cl.² ..... G04B 19/30

[52] U.S. Cl. ..... 58/50 R; 58/23 R; 350/160 R

[58] Field of Search ..... 58/23 R, 23 A, 50 R, 58/126, 127; 350/160 R, 160 LU; 340/335, 336

[56] References Cited

U.S. PATENT DOCUMENTS

| | | | |
|---|---|---|---|
| 3,194,003 | 7/1965 | Polin | 58/50 R |
| 3,485,033 | 12/1969 | Langley | 58/50 R |
| 3,521,941 | 7/1970 | Deb et al. | 58/50 R |
| 3,540,209 | 11/1970 | Zatsky et al. | 58/50 R |
| 3,578,843 | 3/1971 | Castellion | 350/100 R |
| 3,626,410 | 12/1971 | de Koster | 58/23 R |
| 3,756,013 | 9/1973 | Berget et al. | 58/50 R |
| 3,806,229 | 4/1974 | Schoot et al. | 350/160 R |
| 3,839,857 | 10/1974 | Berets et al. | 58/23 R |
| 3,844,636 | 10/1974 | Maricle et al. | 350/160 R |
| 3,879,108 | 4/1975 | Berets | 350/160 R |
| 3,892,472 | 7/1975 | Giglia | 350/160 R |

FOREIGN PATENT DOCUMENTS

| | | | |
|---|---|---|---|
| 1,243,269 | 6/1967 | Germany | 350/160 R |

*Primary Examiner*—Robert K. Schaefer
*Assistant Examiner*—Vit W. Miska
*Attorney, Agent, or Firm*—Blum, Moscovitz, Friedman & Kaplan

[57] ABSTRACT

An electronic wristwatch having an improved digital display is provided. The display elements include first electrodes adapted to be referenced to a first potential and second electrodes spaced apart from said first electrodes and adapted to be charged to at least two distinct potentials. An oxidation-reduction sensitive compound is disposed between said first and second spaced apart electrodes the compound being reduced to a first condition of transparency in response to a first difference in potential between said first and second electrodes and being oxidized to a second condition of transparency in response to a second difference in potential between said first and second electrodes. Novel circuitry is utilized to incorporate the digital display in an electronic wristwatch.

3 Claims, 9 Drawing Figures

ELECTRONIC WRISTWATCH DIGITAL DISPLAY

BACKGROUND OF THE INVENTION

This invention is directed to an improved electronic wristwatch digital display and in particular to the use of a digital display including an oxidation-reduction compound and elctronic wristwatch circuitry for effecting selective activation thereof.

Very precise wristwatches of the mechanical variety have been available for a long time. Such mechanical wristwatches utilize a mechanism in which a balance mainspring is utilized as the time standard. Display hands are rotated by a gear train which gear train is driven in response to the oscillatory period determined by the balanced mainspring.

The gradual incorporation of electronic circuitry into wristwatches to replace mechanical mechanisms has resulted in the development of all electronic timepieces. The substitution of a battery for a mainspring as a power source, and a tuning fork as a time standard for a balance with the mainspring were two early developments. Thereafter, the use of quartz crystal vibrators as the time standard in an oscillator circuit provided highly accurate electronic wristwatches.

Nevertheless, although such developments have occasioned a complete substitution of electronic elements for mechanical elements in the timekeeping movement of an electronic timepiece, most electronic wristwatches still include conventional analog hands mounted to rotate around a dial disk for effective display of time. Although the use of digital display elements such as light emitting diodes and liquid crystals have been utilized, such digital display elements have been less than completely satisfactory. Specifically, liquid crystals do not provide a clear contrast and are not as reliable as the remaining electronic components in the timepiece. On the other hand, light emitting diodes cause excess current consumption and hence dissipate the battery in too short a time. Accordingly, an electronic wristwatch display wherein the numbers displayed thereby are clear, highly reliable and utilize a minimum of current are desired.

SUMMARY OF THE INVENTION

In accordance with the invention, an electronic wristwatch digital display is provided. The digital display includes first electrodes adapted to be referenced to a first potential and second electrodes spaced apart from said first electrodes and adapted to be charged to at least two distinct potentials. An oxidation-reduction sensitive compound is disposed between said first and second spaced apart electrodes the compound being reduced to a first condition of transparency in response to a first difference in potential between said first and second electrodes and being oxidized to a second condition of transparency in response to a second difference in potential between said first and second spaced apart electrodes.

Additionally, electronic wristwatch circuitry for effecting a charging of the second electrodes to one of the distinct potentials to effect one of a pluraiity of conditions of transparency is provided.

Accordingly, it is an object of this invention to provide an electronic wristwatch having a clear time display.

A further object of this invention is to provide an improved electronic wristwatch digital display having improved contrast.

Still a further object of this invention is to provide an electronic wristwatch having a multicolored display.

Still another object of this invention is to provide an improved electronic wristwatch having reduced current consumption and a high degree of reliability.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1A:
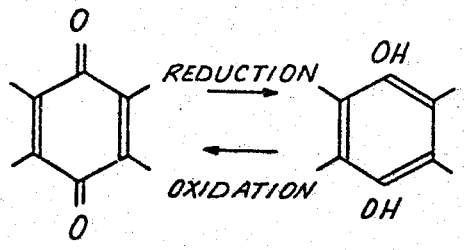
FIG. 1*a* depicts the oxidized and reduced states of a first portion of a dyestuff molecule in accordance with the instant invention.

The instant invention is directed to an improved highly reliable electronic wristwatch digital display requiring a minimum of current to effect energization thereof. Each display element includes dyestuffs of the type used in dyeing, etc., to provide a reversible changing of color tones in accordance with the oxidation and reduction of the dyestuffs. The term dyestuffs refers to both organic dyestuff and inorganic pigments of the type detailed below. Specifically, certain dyestuffs absorb light and hence provide dark colors when oxidized, and are colorless when they are reduced. Still other dyestuffs are colorless when oxidized and strongly absorb light and hence are darkly colored when they are reduced. Still a further characteristic of organic dyestuffs is the difference in degree of solubility of same when the dyestuffs are oxidized or reduced.

The absorption characteristics of different dyestuffs with respect to oxidation and reduction are determined by the oxidation-reduction potential of the dyestufff. Accordingly, by disposing a dyestuff between two spaced apart parallel electrodes referenced at different potentials the absorption spectrum of the dyestuff will vary accordingly. For example, if a reduction type dyestuff is disposed between two transparent electrodes and a voltage is applied to a first electrode to oxidize the dyestuff, a dark color display will be produced thereat.

Specifically, because the solubility of certain dyestuffs in the solvent is decreased, and further because the dyestuffs are deposited on the surface of the electrodes, the characteristics of such dyestuffs render same particularly suitable for use in electronic wristwatch display elements. Accordingly, optical display elements in an electronic wristwatch can be provided by applying a predetermined voltage to an electrode of a predetermined shape to thereby sustain the display characteristic after the voltage is no longer applied. Moreover, high voltages are not required to effect oxidation and reduction, such dyestuffs having oxidation-reduction potentials of less than two volts. In order to effect a change in the color of such dyestuffs, only current sufficient to add and take away the necessary electrons to effect reduction or oxidation respectively is required to obtain the necessary changes in color. Furthermore, because the color of the dyestuff is changed from no color or a very light color to a dark color, a high constrast is obtained. Moreover, display elements sustain the condition of transparency, such as a dark color, intermediate color or no color, as long as current flow is held in abeyance. Such a property is particularly suitable for an electronic wristwatch since current is not required to sustain the transparency condition of the display elements thereby resulting in a considerable reduction in the current required to effect activation of the display elements.

Inorganic dyestuffs which have been found particularly suitable for use in the instant invention are molybdenum oxide, tungsten oxide, niobium oxide, and titanium oxide. Such inorganic dyestuffs have preferred color characteristics when same are oxidized and reduced. Moreover, such inorganic dyestuffs are completely colorless or white colored in the oxidation state, yet when reduced appear to be either colored black or blue.

It is noted that oxidation is characterized by the removal or taking away of electrons whereas reduction is characterized by the adding of electrons. Accordingly, when the oxidation-reduction dyestuff materials are disposed between spaced apart transparent electrodes, and a DC voltage is applied to the respective electrodes, the dyestuff materials on the side of the electrodes referenced to the most negative is effected, causes a coloring of the dyestuff. Thereafter, if a reverse DC potential is applied to the electrodes, a colorless display is obtained by forming the electrode at the most negative potential to be transparent.

It is further noted that the inorganic dyestuffs noted above can be utilized individually or in such combinations as $TiO_2$ - $MoO_3$ or $TiO_2$ - $WO_2$. Both with the individual dyestuffs and the combination of such dyestuffs, the greater the degree of reduction, the darker the color of the display. Moreover, an increase in the applied voltage to the respective electrodes will effect an increase in the speed at which the different colors are generated, which speeding up causes an increase in the number of coloring centers in response to the removal of oxygen from the inorganic dyestuff.

To effect a reversal of the display element from a dark color to a colorless or white state, an opposite polarity electric potential is applied to the display element electrodes or the electrodes are heated. Such reversing of the potential or heating effects an oxidizing or taking away of electrons from the dyestuff. Even if the reverse potential or heating is excessive, the dyestuff compound would become colorless and no further deterioration or change in the state of the dyestuff would occur. Moreover, because the inorganic dyestuffs are utilized in a powder form or as a thin film deposited on a transparent electrode, the characteristics thereof depend on the condition of the powder or thin film, the electrolyte utilized therewith and the electrode materials to which the energization voltages are applied. Of the organic dyestuff compounds which have the same characteristics as the inorganic dyestuffs detailed above, and hence are also particularly suitable for use in the instant invention, dilydroquinone (or dihydric phenol) materials which are made by reducing quinone (or dikenone) are preferred.

Figure 1B:
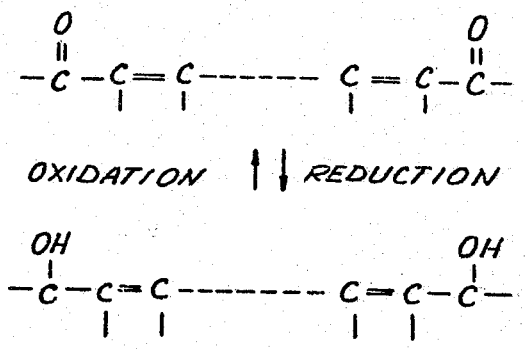
FIG. 1*b* depicts the oxidized and reduced states for another portion of a dyestuff mulecule.
Figure 2:
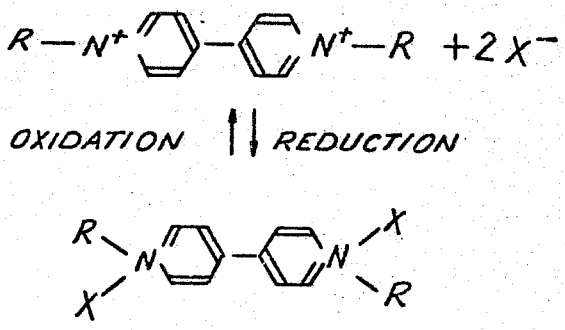
FIG. 2 depicts the oxidized and reduced forms of a viologen dyestuff in accordance with the instant invention.

Reference is now made to FIGS. 1*a* and 1*b* wherein the oxidized and reduced forms of a quinone and dihydroquinone and the oxidized and reduced states of a portion of a dyestuff particle are respectively illustrated. Specifically, a viologen dyestuff which is a derivative of 4,4′ dipyridyl is characterized. Such a dyestuff is colorless in the oxidized state and is sequentially colored blue, purple and red in the in the course of reduction. Referring to FIG. 2, the oxidation-reduction states of the viologen dyestuff is further depicted. In FIG. 2, X is a halogen atom. Because the oxidation-reduction potential of the viologen dyestuff depicted in FIG. 2 is −300 to 450 millivolts, the changing of the color thereof is easily obtained by the application of extremely low voltages to the electrodes. It is noted that in the oxidation state the dyestuff can be dissolved in water or alcohol, but in the reduction state of the dyestuff is hard to melt and deposit on the electrodes. Accordingly, the pattern is formed on a reduction electrode and same is utilized for the display. It is noted that anthrocene or other like materials are likewise effective.

From the foregoing, it is apparent that color tone of the dyestuff compounds can be varied by taking into account the different oxidation-reduction potentials of each dyestuff and the color changes caused thereby. For example, in a fourdigit display, it is possible to utilize a blue hour display and a bluish purple minute display. Apparently, where four distinct types of information namely hours, minutes, date and seconds are displayed, the hours and minutes can be displayed in blue, and the date and second information can be displayed by the same display elements at different times in a bluish purple by merely effecting a change in the voltage applied to the display electrodes. Still further colors are available by selecting a dyestuff having a dark color in the oxidation state and a dyestuff having a dark color in the reduction state and respectively depositing them on the positive and negative electrodes.

Examples of the oxidation-reduction potentials of a dyestuff compound in a solution at pH of 7, is illustrated as follow:

methylviologen: −0.446 volts
benzylviologen: −0.363
2.6 dibromophenol: 0.217

Figure 3:
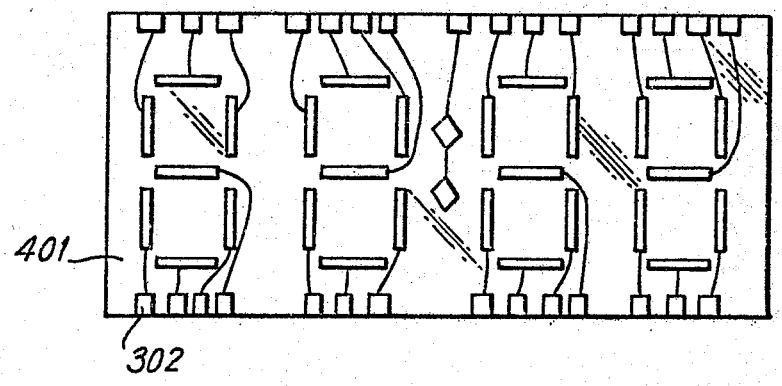
FIG. 3 is a plan view of a digital display constructed in accordance with the instant invention.
Figure 4:
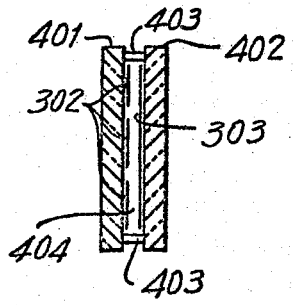
FIG. 4 is a sectional view of the digital display depicted in FIG. 3.

Reference is now made to FIGS. 3 and 4 wherein a digital display constructed in accordance with the instant invention is depicted. Transparent electrodes 302 are disposed on a front surface 401 and a common electrode 303 is disposed on the entire inner rear surface of glass plate 402. Spacers 403 secure front and back plates 401 and 402 together, with a dyestuff compound and an electrolyte sealed in the chamber defined thereby. Alternatively, an identical pattern of electrodes can be disposed on both the front and rear glass plates, such an arrangement being particularly effective in providing a multicolored digital display.

Figure 5A:
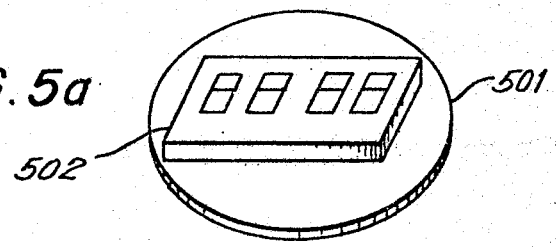
FIG. 5*a* and 5*b* are respective perspective views of a digital display and the electronic circuitry of an electronic wristwatch constructed in accordance with the instant invention.
Figure 5B:
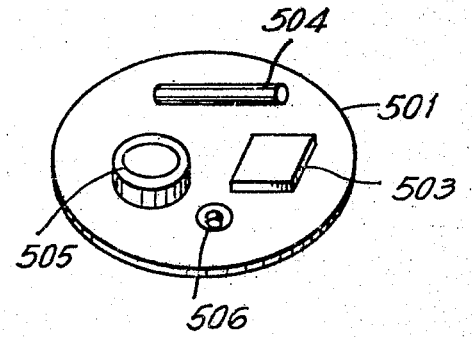
Figure 6:
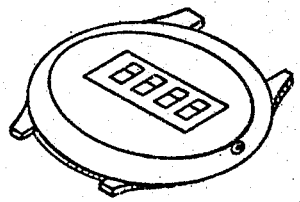
FIG. 6 is a perspective view of an electronic wristwatch constructed in accordance with the instant invention.

Reference is now made to FIGS. 5*a*, 5*b* and FIG. 6 wherein an electronic wristwatch incorporating the digital display detailed above is depicted. A base plate 501 has disposed on a first side thereof a display cell 502 of the type depicted in FIGS. 3 and 4. On the other side of base plate 501 are disposed an integrated circuit chip 503, a quartz crystal oscillator 504, a battery 505 and a trimmer capacitor 506, the circuit chip 501 being adapted to be easily positioned in a wristwatch case of the type depicted in FIG. 6.

Figure 7:
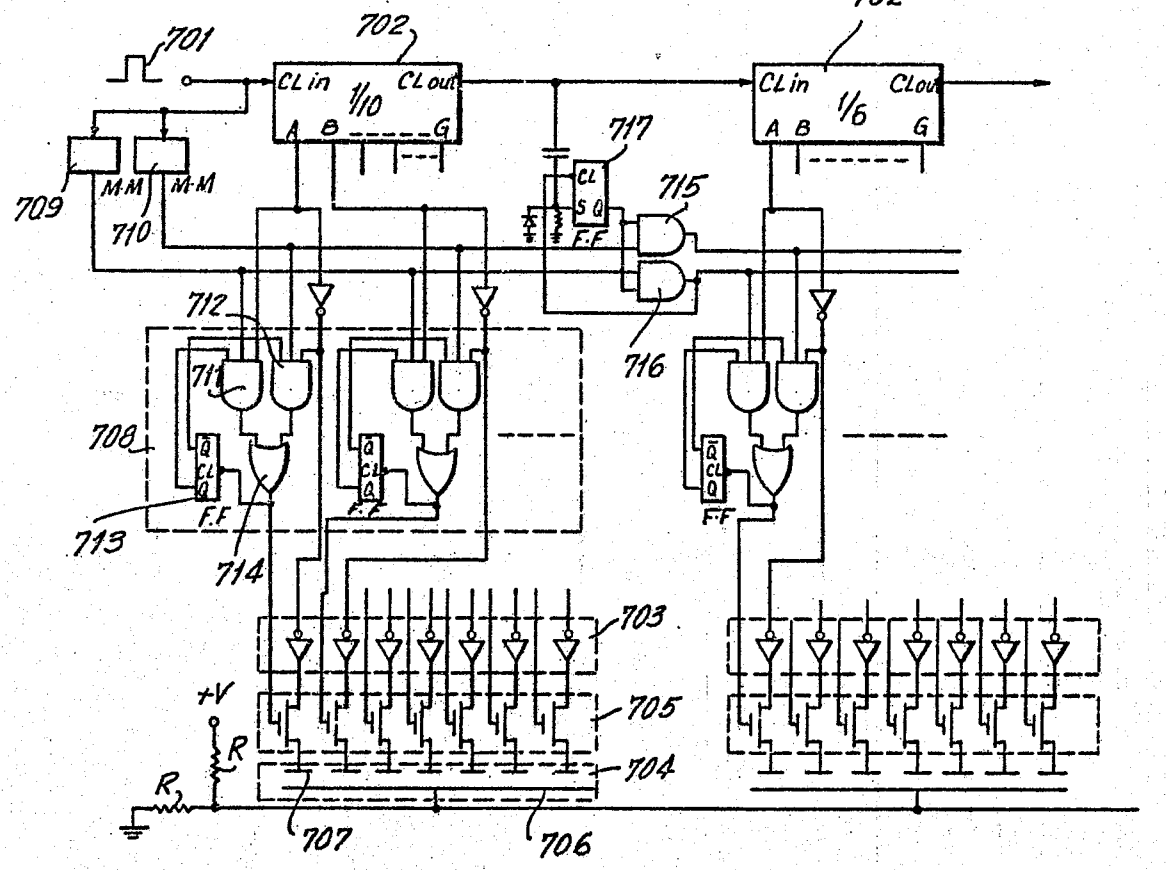
FIG. 7 is a detailed circuit diagram of an electronic wristwatch digital display constructed in accordance with the instant invention.

Referring now to FIG. 7, there is illustrated therein an electronic wristwatch circuit and the manner in which same is utilized to effect an electronic wristwatch having an improved display. For purposes of explanation, the display of minutes and a further digit of time having a longer period of time namely, ten-minutes are illustrated.

The electronic wristwatch includes an oscillator circuit (not shown) for producing a high frequency time standard signal and a divider circuit (not shown) for producing a one minute clock pulse 701 in response to a high frequency time standard signal produced by the oscillator circuit. One minute clock pulse 701 is applied to a 1/10 counter-decoder 702, which counter-decoder produces signals A through G for driving the respective segment electrodes of the digital display elements, discussed with greater particularity below. Additionally, a 10-minutes signal is applied to the next stage of the 1/6 counter-decoder 702' in response to each ten pulses applied to counter-decoder 702.

Seven-bar display 704 includes seven segmented electrodes each defining a display cell with common electrode 706. Each respective display cell is rendered transparent or colored in response to segment signals applied to each driver element 703. The common electrode 706 is referenced to a potential +V. Accordingly, each display cell is respectively colorless or colored in response to a potential difference of +V/2 or −V/2 referenced to the fixed potential of the common electrode 706. The application of a drive signal having a potential +V/2 to a segment electrode 705, when the common electrode 706 is referenced to +V, will effect a coloring of the display cell in accordance with the oxidation-reduction characteristic of the dyestuffs detailed above.

Once the dyestuff compound is colored, the display cell remains in the oxidized or reduced state which corresponds to the coloring of the dyestuff until the potential applied to the respective display cell segment electrode is reversed whereafter the display cell is rendered colorless or clear. Because the display cell remains in the particular condition of transparency i.e. colored or colorless, once a sufficient amount of current is provided to effect reduction or oxidation, it is not necessary to continue to apply current to the display cell in order to maintain the state thereof, and hence a considerable reduction in the amount of current results. Moreover, the display cells corresponding to the digits of time which are not often changed such as hours, remain a consistent color until same are rendered colorless, thereby avoiding any deterioration of the quality of the display element over the period that same remains unchanged.

Because the potential of each display cell must be reversed in order to effect a change in the condition of transparency thereof, a switching circuit 705 controlled by switching control circuit 708 is disposed intermediate the driver circuit 703 and display element 704. The one-minute clock pulse 701 is applied to mono-stable vibrators 709 and 710 which mono-stable vibrators produce signals representative of a predetermined pulse width necessary for application of the respective voltages to the display cell segment electrodes to effect oxidation or reduction thereat. The switching control circuit 708 includes AND gates 711 and 712, OR gate 714 and flip-flop 713 for each display cell segment electrode. AND gate 711 includes as a first input, a segment drive signal from the counter-decoder circuit and as a further input the pulse width signal from mono-stable miltivibrator 709. AND gate 712 is adapted to receive an inverted segment signal from counter 702 and a pulse width signal from mono-stable multivibrator 710. Finally, flip-flop circuit 713 is adapted to receive the pulse produced by OR gate 714 and in response thereto apply a first pulse Q as the third input to AND gate 711 and the complement thereof $\overline{Q}$ as the third input to AND gate 712. Thus, either AND gate 711 or AND gate 712 will remain open and hence only a change in the condition of transparency of the display cell will cause a change in the segment electrode signal and result in a change of state signal being applied to switching circuit 705 to thereby permit the application of a segment drive signal to a display cell electrode 707 to effect a change in the state thereof.

It is noted that the control of the display elements and in particular the minute digit is effectively controlled, and that such circuitry is equally adapted for effecting control of the ten-minute, hour and 10-hour display digits. Nevertheless, the pulse width signal from the multivibrators 709 and 710 has a different period and therefore cannot be utilized for changing the upper digits. Accordingly, AND gates 715 and 716 and a further flip-flop circuit 717 utilizes the output of the previous counter decoder as a trigger pulse. Nevertheless, the output of AND gate 716 is used to effect the opening and closing of the gates by producing a signal which is fed back to the input circuit of flip-flop 717. Accordingly, a pulse having the same period and the same pulse width as the output clock pulse of the digit to be displayed is provided in the same manner as was provided to the minute display. Accordingly, the electronic timepiece circuit effects a changing of the state of the respective display cells each time the display segment signal produced by the counter-decoder associated therewith is changed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic wristwatch having electronic timekeeping circuitry for producing a periodic timekeeping signal representative of actual time, the improvement comprising at least one counter-decoder means adapted to receive said periodic timekeeping signal and in response thereto selectively produce a plurality of display segment drive signals, display means including a plurality of segmented electrodes forming a display digit and a further common electrode spaced apart from said segmented electrodes, said common electrode being referenced to a fixed potential, and an oxidation-reduction compound disposed between said segmented electrodes and said common electrode, a plurality of control switching means, each said control switching means being coupled to a display segment electrode, each said control switching means being adapted to receive said timekeeping signal and a respective segment driving signal and in response thereto effect a changing of the potential of said segmented electrode to change the condition of transparency of said portion of said oxidation-reduction sensitive compound between each said segmented electrode and said common electrode to correspond to the absence or presence of a segment drive signal applied to the segment electrode during each period of the timekeeping signal, each said control switching means further including a control switching circuit adapted to apply one of a first potential and second potential control signal once each period of said timekeeping signal, and a switching circuit adapted to receive said control signal, and in response to the potential thereof, reference said segmented electrode thereto, and including first and second mono-stable multi-vibrators adapted to receive said periodic timekeeping signals and in response thereto respectively produce first and second pulse width signals respectively determinative of the period to effect oxidation and reduction of the portions of the oxidation-reduction sensitive compounds between said first segmented electrodes and said common electrode, each said control switching circuit including first and second gate means respectively adapted to receive said first and second pulse width signals, and feedback gating means coupled to said first and second gating means for alternating the opening and closing of said first and second gating means, said first second gating means being adapted to receive said segment drive signals and in response thereto and the alternate opening and closing thereof apply said first and second potential control signal to said switching circuit for a duration determined by said pulse width signal.

2. In an electronic timepiece having electronic timekeeping circuitry for producing periodic timekeeping signals representative of actual time, and counter-decoder means adapted to receive said periodic timekeeping signals in response thereto and selectively produce a plurality of display segment drive signals, the improvement comprising display means including first and second glass plates, and means for spacing apart said glass plates and forming a sealed enclosure with said glass plates, said sealed enclosure including a first plurality of transparent segmented electrodes disposed on the inner surface of said first glass plate, said first segmented electrodes being coupled to said counter-decoder means for receiving display segment drive signals produced thereby, and second electrode means disposed on the inner surface of said second glass plate, and a viologen dyestuff disposed proximate to one of said first segmented electrodes and said second electrode means, said dyestuff having a purple color at a reduction stage, and an electrolyte in solvent selected from the group consisting of water and alcohol.

3. An electronic timepiece as claimed in claim 2, wherein said second electrode means is a plurality of transparent segmented electrodes formed in the same pattern as said first transparent segmented electrodes and spaced apart from the associated first segmented electrode to define display segments therewith.

* * * * *